US008850654B2

(12) United States Patent
Nolan et al.

(10) Patent No.: US 8,850,654 B2
(45) Date of Patent: Oct. 7, 2014

(54) UPRIGHT STEAM MOP WITH AUXILIARY HAND TOOL

(75) Inventors: Matthew P. Nolan, Grand Rapids, MI (US); Alan J. Krebs, Pierson, MI (US); Kurt E. Ashbaugh, Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 158 days.

(21) Appl. No.: 13/389,899

(22) PCT Filed: Aug. 11, 2010

(86) PCT No.: PCT/US2010/045167

§ 371 (c)(1), (2), (4) Date: Feb. 10, 2012

(87) PCT Pub. No.: WO2011/019814

PCT Pub. Date: Feb. 17, 2011

(65) Prior Publication Data

US 2012/0137465 A1 Jun. 7, 2012

Related U.S. Application Data

(60) Provisional application No. 61/232,971, filed on Aug. 11, 2009.

(51) Int. Cl.
*A47L 11/34* (2006.01)
*A47L 13/22* (2006.01)

(52) U.S. Cl.
CPC ..... *A47L 13/22* (2013.01); *A47L 13/225* (2013.01)
USPC ..... 15/321; 15/320; 15/322; 15/328; 15/331; 134/105

(58) Field of Classification Search
CPC ..... A47L 13/225; A47L 11/34
USPC ..... 15/320–322, 331; 134/102.1, 102.2, 134/105, 106
See application file for complete search history.

(56) References Cited

U.S. PATENT DOCUMENTS 4,167,799 A * 9/1979 Webb ..... 15/320
6,584,990 B2 * 7/2003 Shaw ..... 134/105

(Continued)

FOREIGN PATENT DOCUMENTS

AU 2009100238 3/2009
CN 1223843 A 7/1999

(Continued)

OTHER PUBLICATIONS

DE10258832A1 (Abstract), 2004.*

(Continued)

*Primary Examiner* — Mark Spisich
*Assistant Examiner* — Andrew A Horton
(74) *Attorney, Agent, or Firm* — McGarry Bair PC

(57) ABSTRACT

An upright bare floor cleaner with a handle assembly pivotally mounted to a base assembly. The handle includes a water tank to store a quantity of water and a fluid distribution system that includes a heater and a spray nozzle. Steam is generated by the heater and is distributed to a removable cleaning cloth that applies the steam to the surface to be cleaned. The fluid distribution system further includes an auxiliary hand tool for steam cleaning above-floor surfaces.

16 Claims, 16 Drawing Sheets

(56) References Cited

U.S. PATENT DOCUMENTS

| | | | | |
|---|---|---|---|---|
| 7,516,565 | B1 * | 4/2009 | Tsen | 38/77.1 |
| 2002/0144374 | A1 * | 10/2002 | Tsen | 15/321 |
| 2002/0166193 | A1 * | 11/2002 | Kasper | 15/320 |
| 2005/0273972 | A1 * | 12/2005 | Park | 15/414 |
| 2007/0020020 | A1 * | 1/2007 | Bobrosky et al. | 401/9 |
| 2007/0169304 | A1 * | 7/2007 | Tsai | 15/320 |
| 2008/0189901 | A1 | 8/2008 | Jansen | |
| 2009/0094782 | A1 * | 4/2009 | Lenkiewicz | 15/320 |
| 2010/0126533 | A1 * | 5/2010 | Nottingham et al. | 134/105 |

FOREIGN PATENT DOCUMENTS

| | | | | |
|---|---|---|---|---|
| CN | 2525928 | Y | 12/2002 | |
| DE | 10258832 | A1 * | 7/2004 | F16K 11/00 |
| DE | 202009002302 | U1 | 5/2009 | |
| EP | 1690488 | A1 | 8/2006 | |
| JP | 2000316769 | A | 11/2000 | |
| KR | 100849861 | B1 | 10/2007 | |
| KR | 1020070103094 | A | 10/2007 | |
| KR | 100773728 | B1 | 11/2007 | |
| WO | 2005018402 | A2 | 3/2005 | |

OTHER PUBLICATIONS

A Eckenschwiller, Supplementary European Search Report, Dec. 14, 2012, 2 pages, Munich.

The First Office Action, Dec. 6, 2013, 14 pages, People's Republic of China.

* cited by examiner

UPRIGHT STEAM MOP WITH AUXILIARY HAND TOOL

CROSS-REFERENCE TO RELATED APPLICATIONS

This application is a National Phase Application of International Application No. PCT/US2010/045167, filed Aug. 11, 2010, and claims the benefit of U.S. Provisional Patent Application No. 61/232,971, filed Aug. 11, 2009, which is incorporated herein by reference in its entirety.

BACKGROUND OF THE INVENTION

1. Field of the Invention

This invention relates to an upright bare floor cleaner. In one aspect, the invention relates to a bare floor cleaner that performs steam mopping. In another aspect, the invention relates to an upright steam mop having an auxiliary hand tool for steam cleaning above-floor surfaces. In yet another aspect of the invention, an upright steam mop has a removable steam module for portable, above-floor steam cleaning. The steam mop of the invention provides both floor and above-floor steam cleaning.

2. Description of the Related Art

Conventional mops are well known for cleaning a bare floor surface, such as tile, linoleum, and hardwood floors. The most common cleaning tool for this procedure is the traditional sponge or rag mop. Mops are capable of loosening dirt from the floor and have excellent absorbency; however, when the mop requires more cleaning solution, it is placed in a bucket to soak up warm cleaning solution and returned to the floor. Each time more cleaning solution is required, the mop is usually placed in the same bucket, and after several repetitions the cleaning solution becomes dirty and cold. As a result, dirty cleaning solution is used to remove dirt from the bare surface. Mops generally require use of chemicals which can be problematic for users that have allergies or other sensitivities to cleaning chemicals, fragrances, etc.

There has been an increased interest in environmentally friendly methods for household cleaning and the interest in steam cleaning in the home has also increased. This method of cleaning has the advantage of using water rather than chemicals, which are expensive and can have negative environmental impacts. Further, steaming devices used to apply steam to household objects are well known. The uses of the devices vary widely, and may include the application of steam to drapes or other fabrics to ease wrinkles, and the application of steam to objects to assist in cleaning the objects.

Recent trends in cleaning bare floors involves the use of steam as the cleaning agent. Typical steam devices have a reservoir for storing water that is connected to an electrical water pump with an on/off switch. The exit from the electric water pump is connected to a steam boiler with a steam generator to heat the water. The heated water generates steam, which may be directed towards the intended destination through a nozzle which controls the application of the steam. Variation of the shape and size of the nozzle allows for preferred distribution of generated steam to an object to be cleaned. Different nozzles may be interchanged, based on the object to be steamed. The nozzle may be either closely coupled to the steam generator, or located at a distance from the steam generator, requiring tubing or other steam transfer structures to be interconnected between the steam generator and the discharge nozzle. Steam systems have the advantage of creating a temperature which effectively kills a wide range of microbes, bacteria, microorganisms, and dust mites. Conversely, conventional detergent cleaning systems are somewhat effective at cleaning surfaces, but could be made more effective by raising the temperature of the cleaning solution to some point below the boiling point.

A bare floor cleaner has heretofore been sold in the United States by BISSELL Homecare, Inc. under the mark Steam Mop. The Steam Mop comprises a base assembly and an upright handle pivotally mounted to the base assembly. The base assembly includes a base housing with a fluid distributor for distributing fluid to the surface to be cleaned; and a mop cloth which is affixed beneath the base housing and positioned for contacting the surface to be cleaned. The upright handle includes a handle housing; a water tank mounted to the handle housing and adapted to hold a quantity of water; a fluid distribution system between the water tank and the base housing fluid distributor for distributing fluid from the water tank to the mop cloth for applying the steam to the surface to be cleaned; and a steam generator within the fluid distribution system for heating the water from the water tank to steam.

SUMMARY OF THE INVENTION

According to the invention, a bare floor cleaner comprises a housing having a fluid distribution system for distributing fluid to a surface to be cleaned, and a foot, and a steam generator is mounted to the housing. The fluid distribution system comprises a fluid distributor in the foot for distributing fluid to a floor surface, an auxiliary hose for distributing fluid to an above floor surface; and a fluid control system associated with the fluid distribution system for selectively distributing fluid to the fluid distributor. The fluid control system can selectively distribute steam to either onto foot fluid distribution to deliver steam to the surface to be cleaned or to the auxiliary hose for above floor surface cleaning.

In one embodiment, the fluid control system includes a diverter valve and a selector for selectively controlling the diverter valve for distributing steam either to the foot or the auxiliary hose.

In another embodiment, the fluid control system comprises a live hose that is selectively connected to the fluid distributor for delivery of steam to the fluid distributor or to the live hose for above floor distribution. In addition, the fluid control system can be a mechanical or an electrical arrangement.

In another embodiment, the auxiliary hose has a handheld nozzle and a fluid control valve, and the fluid control system comprises a receiver mounted on the housing for selectively receiving the handheld nozzle and is adapted to open the fluid control valve when the handheld nozzle is positioned in the receiver. The fluid distributor selectively distributes steam from the fluid distribution system onto the surface to be cleaned when the handheld nozzle is received in the receiver and the auxiliary hose selectively distributes steam from the fluid distribution system onto the surface to be cleaned when the handheld nozzle is removed from the receiver.

In another embodiment, the housing further comprises an upright handle pivotally mounted to the foot. A steam module is removably mounted to the upright handle, and the steam module includes the auxiliary hose, at least a portion of the fluid control system and a fluid connector between the receiver and the foot for selective distribution of steam to the foot when the steam module is mounted to the foot.

Preferably, a water tank is mounted to the housing or the foot and is adapted to hold a quantity of water. The water tank is connected to the fluid distribution system for distributing fluid from the water tank to the surface to be cleaned.

In one embodiment, the bare floor cleaner includes a cleaning cloth that is affixed to an under surface of the foot and is positioned for contacting the surface to be cleaned.

In one embodiment, the foot fluid distributor is positioned above the cleaning cloth for distributing steam to the cleaning cloth.

In another embodiment, the bare floor cleaner further comprises a trigger on the handle operably connected to the fluid distribution system for selectively distributing steam onto the surface to be cleaned.

In one embodiment, the foot is pivotally mounted to the upright handle through a universal joint.

In one embodiment, the auxiliary hose is comprised of a flexible conduit, a handheld nozzle, and a manually operable control valve.

In another embodiment, the steam module further comprises a support stand having support legs that can be deployed or refracted for supporting the steam module when removed from the steam mop.

In one embodiment, the auxiliary hose can be connected to the housing through an articulating joint. In addition, the auxiliary hose is mounted to the articulating joint for rotation about an axis.

In another embodiment, the fluid distribution system further comprises a moisture controller for selectively controlling the amount of moisture in the steam delivered to the fluid distributor and to the auxiliary hose.

In yet another embodiment, the fluid control system comprises an electrical system for controlling the output of steam to the steam generator when the steam module is mounted to the upright handle and for controlling the delivery of steam to the auxiliary hose when the steam module is removed from the upright module.

In yet another embodiment, fluid distribution system comprises a water tank and a pump connected to the water tank and to the steam generator inlet for supplying water to the steam generator; and wherein the fluid control system comprises and electrical circuit for controlling power to the pump.

DESCRIPTION OF EMBODIMENTS OF THE INVENTION

Figure 1:
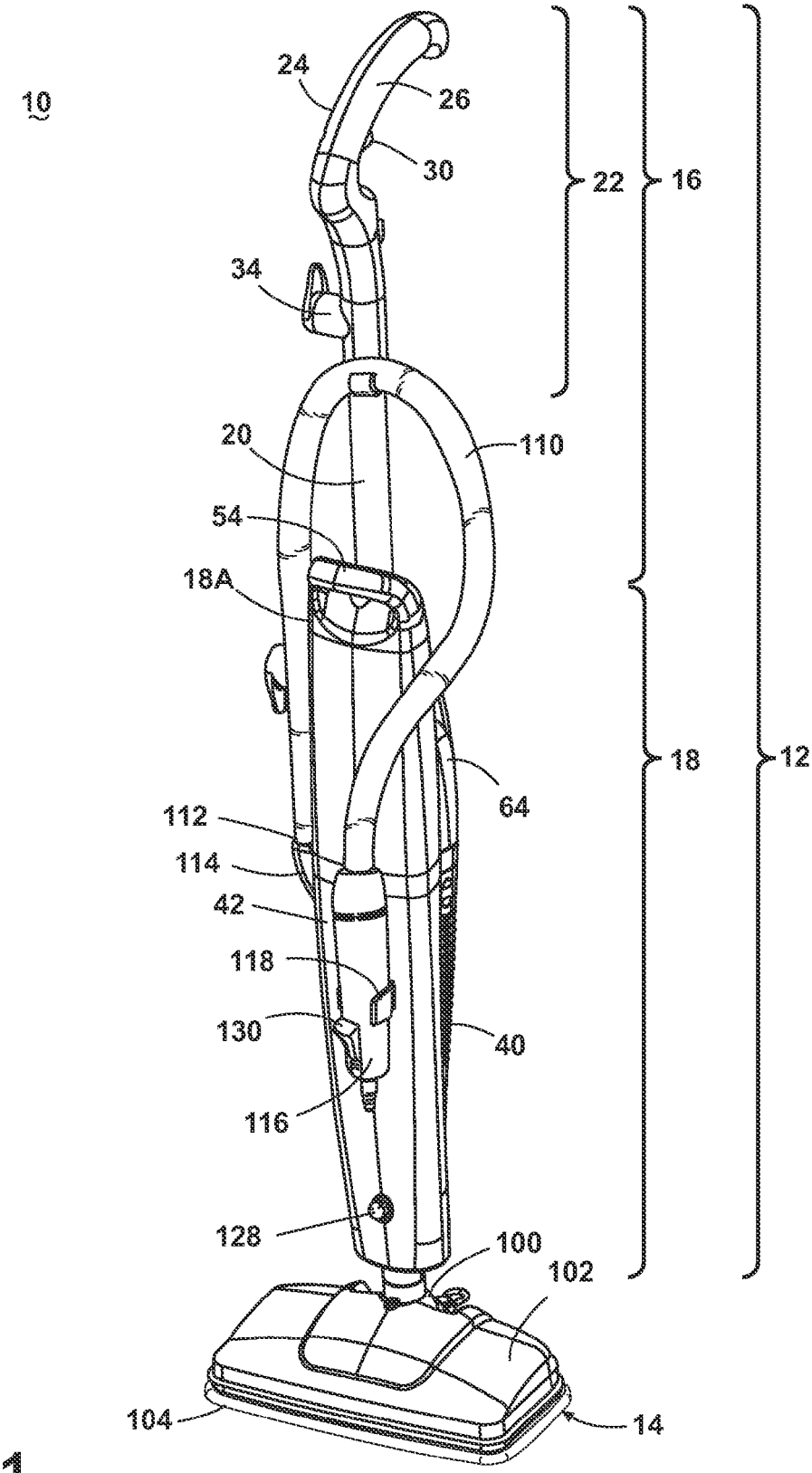
FIG. 1 shows a steam mop according to a first embodiment of the invention.

Referring now to the drawings and to FIG. 1 in particular, a steam mop 10 with an auxiliary hand tool according to the invention comprises a housing with an upright handle assembly 12 and a base or foot 14 pivotally mounted to the handle. The handle assembly 12 can pivot from an upright or vertical position, where the handle assembly 12 is substantially vertical relative to a surface to be cleaned, to a lowered position, whereby the handle assembly 12 is rotated in a rearward direction relative to the foot 14 to an acute angled relative to the surface to be cleaned. The steam mop 10 does not incorporate traditional wheels associated with vacuums; instead, the steam mop 10 is adapted to glide across the floor on the foot 14.

Figure 2:
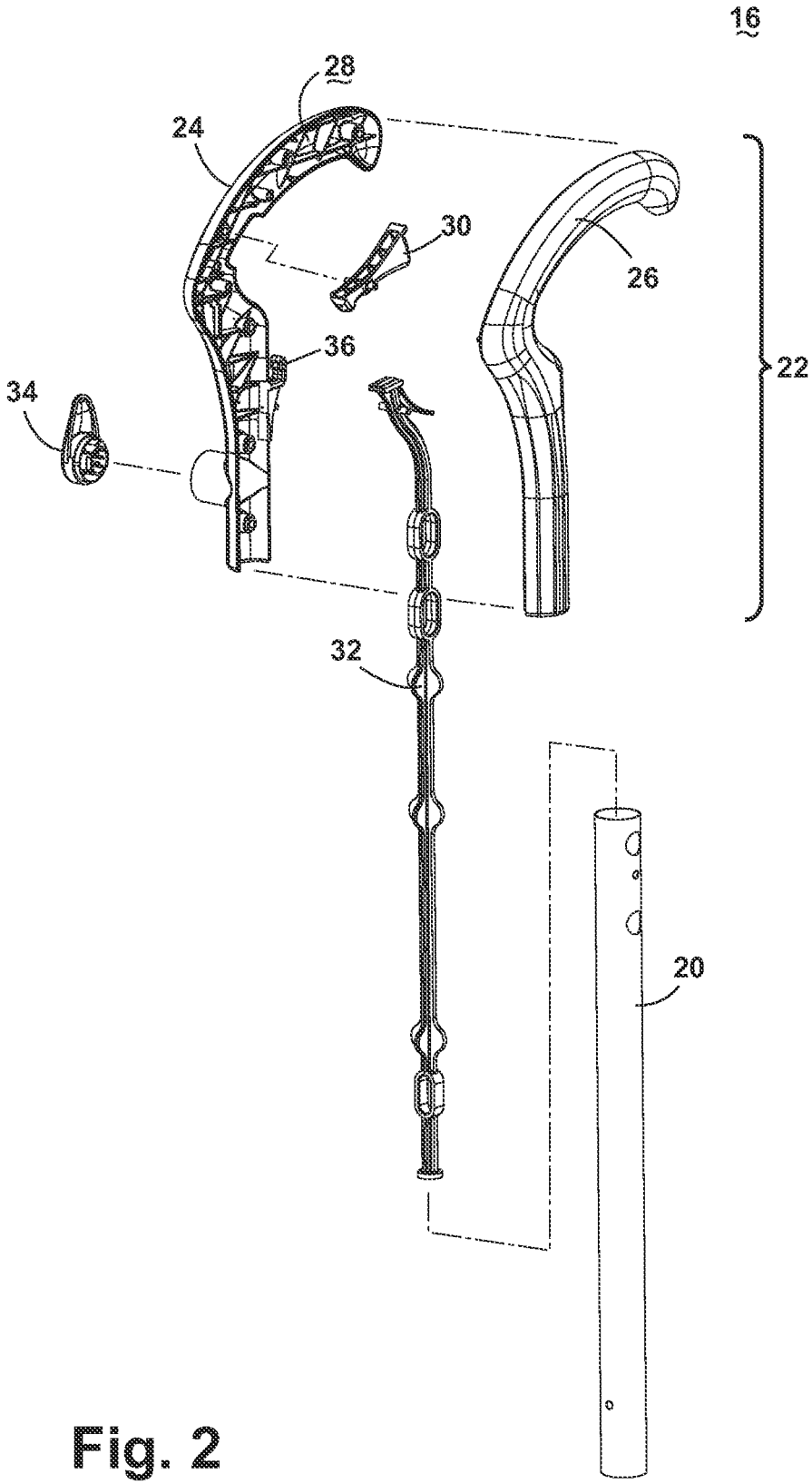
FIG. 2 is an exploded view of an upper handle assembly of the steam mop shown in FIG. 1.

The handle assembly 12 comprises an upper handle assembly 16 and a lower handle assembly 18. The upper handle assembly 16 comprises a hollow handle tube 20 having a grip assembly 22 fixedly attached to a first end of the handle tube 20 and the lower handle assembly 18 fixedly attached to a second end of the handle tube 20 via screws or other suitable commonly known fasteners. The grip assembly 22 has an arcuate grip portion; however, it is within the scope of the invention to utilize other grips commonly found on other machines, such as closed-loop grips having circular or triangular shapes. Referring to FIG. 2, the grip assembly 22 comprises a right handle half 24 that mates with a left handle half 26 and provides a user interface to manipulate the steam mop 10. The mating handle halves 24, 26 form a cavity 28 therebetween. A trigger 30 is partially mounted within the cavity 28, with a portion of the trigger 30 projecting outwardly from the grip assembly 22 where it is accessible to the user. The remainder of the trigger 30 resides in the cavity 28 formed by the handle halves 24, 26 and communicates with a push rod 32 that is positioned within the hollow interior of the handle tube 20. The trigger 30 is pivotally mounted to the handle halves 24, 26 so that the trigger 30 can rotate relative to the grip assembly 22 in a conventional manner. The grip assembly 22 further comprises a cord wrap 34, and a cord lock 36. The cord wrap 34 is adapted to support an electrical cord (not shown) when not in use, and the cord lock 36 is adapted to retain one loop of the electrical cord near the top of the handle assembly 12 during use, thus keeping the cord out of the mop's path.

Figure 3:
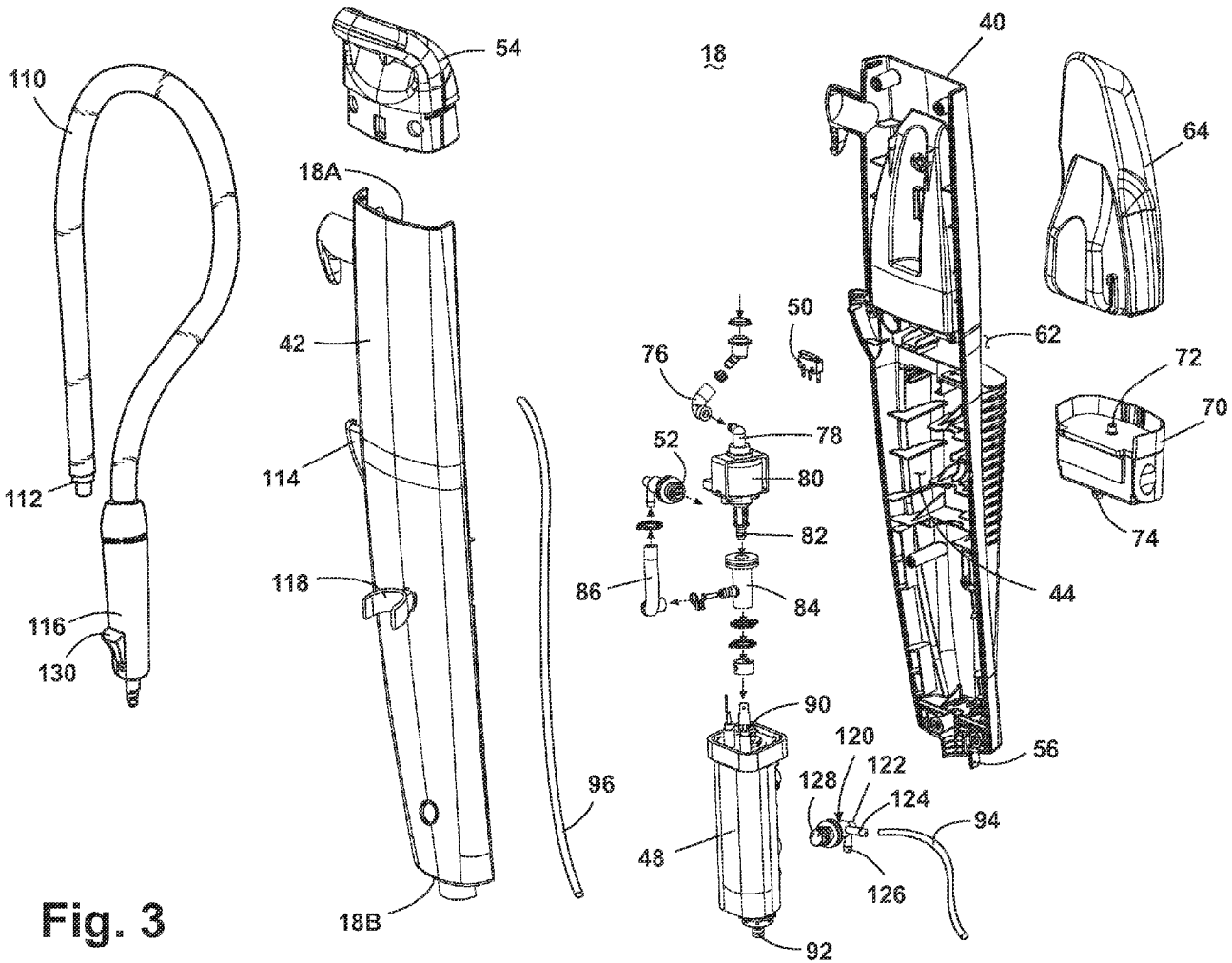
FIG. 3 is an exploded view of a lower handle assembly of the steam mop shown in FIG. 1.
Figure 4:
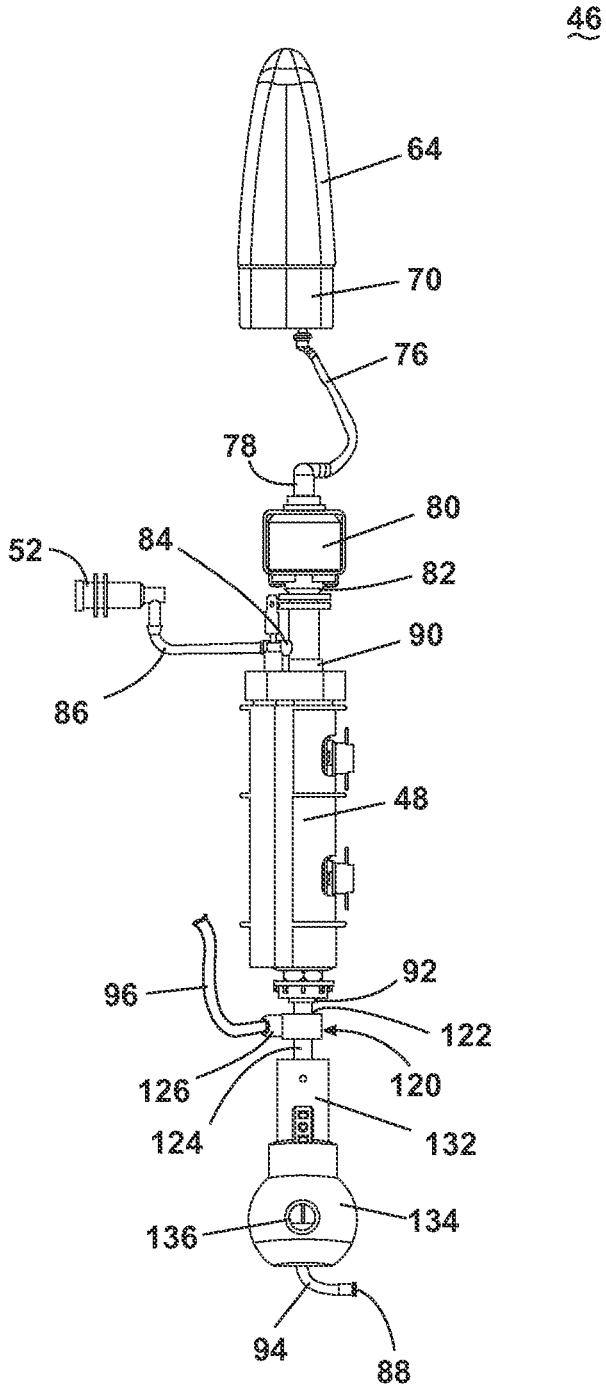
FIG. 4 is a diagram of a fluid distribution system of the steam mop shown in FIG. 1.

As shown in FIG. 3, the lower handle 18 comprises a generally elongated rear enclosure 40 that provides structural support for components of the steam mop 10 contained therein. A front enclosure 42 mates with the rear enclosure 40 to form a central cavity 44 therebetween to house a fluid distribution system 46 (FIG. 4). A steam generator 48, a micro-switch 50, a pump 80, and a pressure relief valve 52 are mounted in the central cavity 44. The lower handle 18 comprises an upper end 18A and a lower end 18B, and a carry handle 54 located at the upper end 18A. The carry handle 54 is disposed at an acute angle relative to the tube 20 and facilitates manually lifting the steam mop 10 from the surface to be cleaned. The lower end 18B of the lower handle 18 comprises a generally circular conduit 56 by which the handle assembly 12 is mounted to the foot 14.

The lower handle assembly 18 further comprises a recess 62 in the rear enclosure 40 in which a water tank assembly 64 is removably mounted. The water tank assembly 64 comprises a tank with an inlet and outlet (not shown) to hold a predetermined amount of liquid, preferably water or electrolyzed water. See for example, US20010034922 for electrolytic steam vacuum, U.S. Pat. No. 4,327,459 for vacuum with electrolytic steam generator, and JP2005006816A2 for floor mop with electrolytic cell. Optionally, various additives can be mixed with the water including a variety of cleaning chemicals, fragrances, botanical oils, and the like. The water tank assembly 64 is in fluid communication with a filter assembly 70, which includes a housing having an inlet 72 and an outlet 74 and which contains de-ionizing crystals. A first water tube 76 fluidly communicates between an inlet port 78 for the pump 80 and the filter assembly 70. An outlet port 82 of the pump 80 fluidly communicates with a T-connector 84. The T-connector 84 is fluidly connected to both the pressure relief valve 52, via a second water tube 86, and the steam generator 48.

The steam generator 48 is electrically coupled to the power source (not shown) and has an elongated boiler that includes an inlet 90 at one end that is fluidly connected to the pump 80 via the T-connector 84. Filtered water is heated while passing through the steam generator 48 and exits at its opposite end, via an outlet port 92, which is fluidly connected to a first steam tube 94. The steam generator 48 can be a flash steam heater or a boiler for generating steam.

Referring additionally to FIG. 4 in which the fluid distribution system 46 is diagrammatically shown, fluid from the water tank assembly 64 is conveyed to a spray nozzle 88 that is mounted in the foot 14 through the first outlet 124, a connector 126, a swivel ball joint 134 and the first steam tube 94 for dispensing steam for cleaning the floor. The swivel ball joint 134 is rotatably received in ball socket (not shown) for swivel mounting of the handle assembly 12 with respect to the foot 14. A pair of bosses 136 is provided on the swivel ball joint 134 for pivotally mounting the ball joint to the foot in conventional manner. The fluid distribution system 46 is controlled by the microswitch 50, which is electrically connected to the pump 80. The pump 80 is selectively activated when the user depresses the trigger 30 (FIG. 2), which forces the push rod 32 (FIG. 2) to travel a predetermined distance along its longitudinal axis to actuate the microswitch 50. Depressing the trigger 30 actuates the microswitch 50 and energizes the pump 80 to dispense steam onto a cleaning cloth 104 (FIG. 5), as described below, in contact with the floor.

Alternatively, the fluid distribution system 46, including the water tank assembly 64, can be mounted to the foot 14.

Referring back to FIG. 1, the handle assembly 12 is pivotally mounted to the foot 14 by a handle pivot assembly 100. The handle pivot assembly 100 is a commonly known universal joint, enabling the foot 14 to swivel multi-axially relative to the handle assembly 12. Additionally, the handle assembly 12 can incorporate an upright locking device (not shown) to lock the steam mop 10 in an upright position as is well known in the art.

Figure 5:
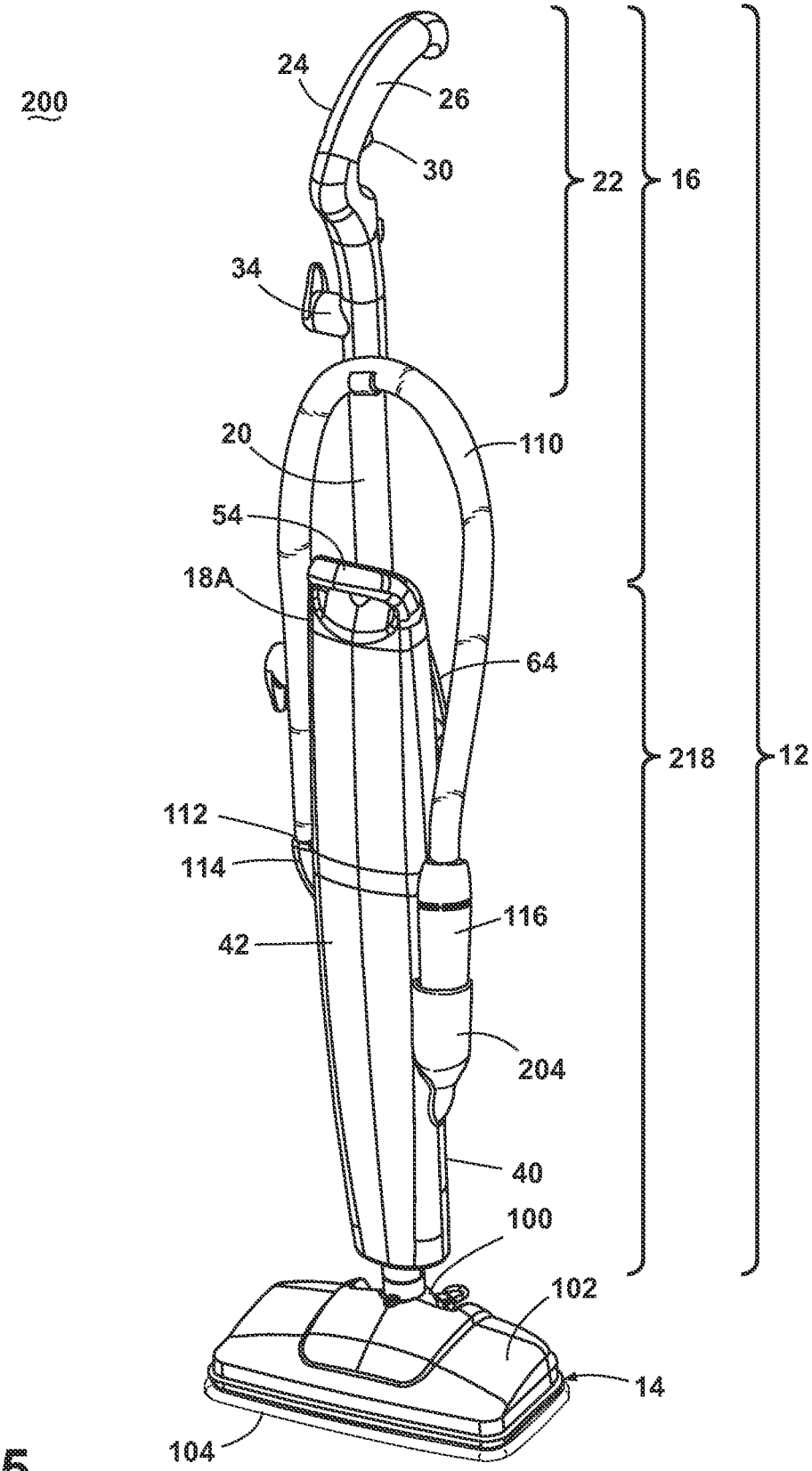
FIG. 5 shows a steam mop according to a second embodiment of the invention.

Referring now to FIG. 5, the foot 14 further comprises a cleaning head 102 to which a commonly known cleaning cloth 104 is attached. The spray nozzle 88 (FIG. 4) is mounted within the cleaning head 102 and is adapted to dispense steam onto the cleaning cloth 104 for cleaning the floor. It is contemplated that the foot 14 can further comprise a rotatably mounted brush or oscillating cleaning cloth 104 for agitating and loosening foreign matter, such as dirt, dust and the like. Alternatively, the foot 14 can also include a sweeper assembly provided by a rotatably mounted brush and dirt collection bin for collecting dirt and dust.

As shown in FIGS. 1 and 3, the steam mop 10 further includes a flexible auxiliary steam hose 110 for applying steam to above-floor surfaces. At one end, the steam hose 110 is fluidly connected by a hose fitting 112 to a steam conduit 114 located on the lower handle assembly 18. At the distal end, the steam hose 110 is fluidly connected to a handheld nozzle 116. When not in use, the handheld nozzle 116 can be removably retained to the steam mop 10 by a hose clip 118.

Referring also to FIG. 4, the fluid distribution system 46 as described above further includes a diverter valve 120. The diverter valve 120 is located at the outlet 92 of the steam generator 48 and can selectively divert steam to either the foot 14 spray nozzle 88 or the steam hose 110 and handheld nozzle 116. The diverter valve 120 comprises an inlet 122 and two outlets 124, 126. The diverter valve inlet 122 is fluidly connected to the steam generator 48 outlet 92. The first outlet 124 is fluidly connected to the spray nozzle 88 via the first steam tube 94 for steam cleaning the floor. For above-floor cleaning, the second diverter valve 120 outlet 126 is fluidly connected to the handheld nozzle 116 via a second steam tube 96 and the steam conduit 114 and steam hose 110, all of which are fluidly connected.

The diverter valve 120 can be manually controlled to select the mode of steam application by selectively turning a selector, such as a knob 128, which in turn moves a valve element within the valve to connect the inlet 122 with the outlet 124 or the outlet 126. In the illustrations, the knob 128 is shown on the front enclosure 42 of the lower handle 18: however other locations are possible. The knob 128 controls which outlet 124 or 126 is in fluid communication with the fluid distribution system 46, as is commonly known in the art.

The handheld nozzle 116 comprises a trigger 130 and a conventional normally closed valve (not shown) for selectively releasing steam. When the trigger 130 is squeezed, the valve opens and steam supplied by the fluid distribution system 46 passes through the steam hose 110 and is released out the handheld nozzle 116. It is contemplated that various cleaning attachments can be removably mounted to the handheld nozzle 116 for above-floor steam cleaning.

Figure 6:
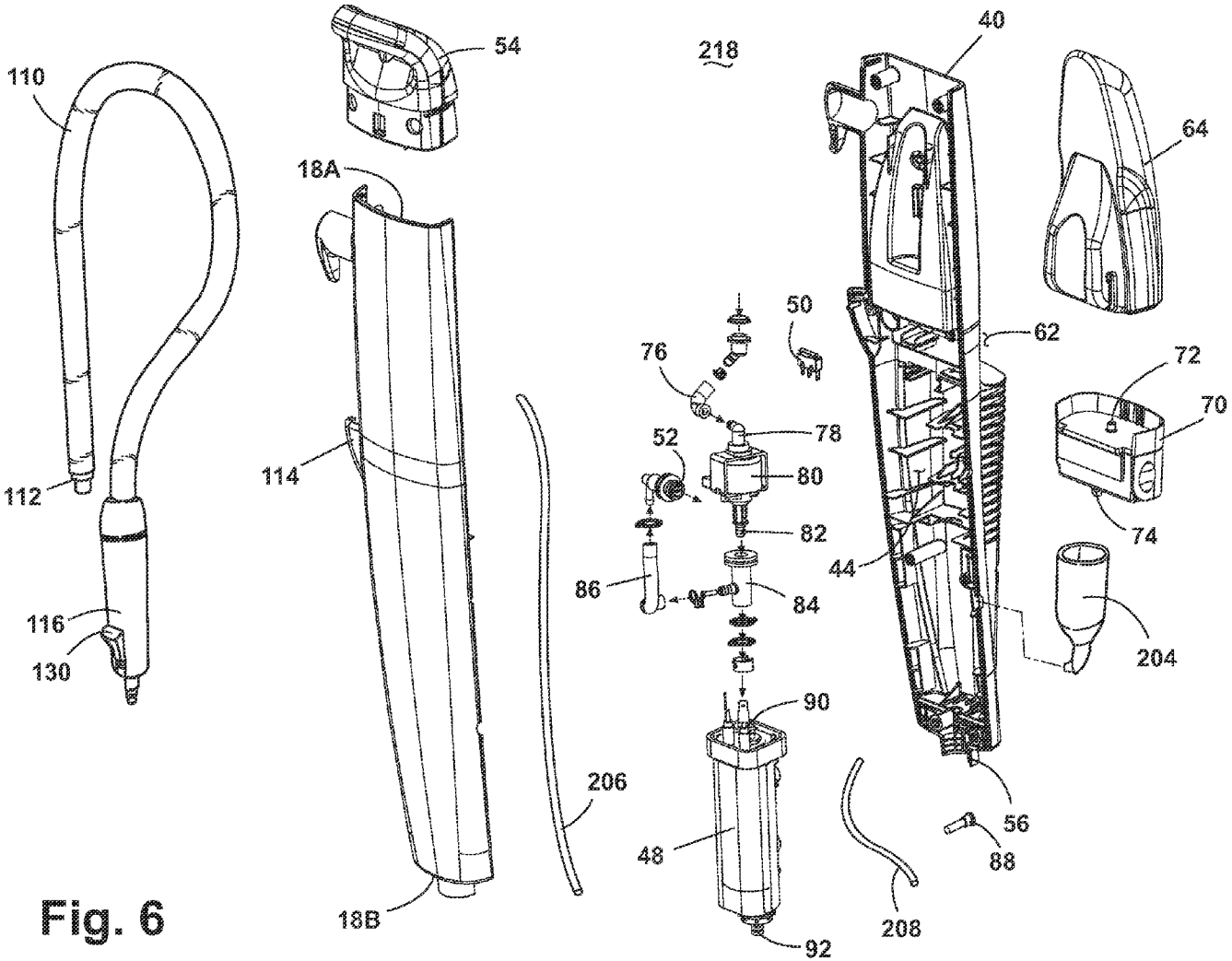
FIG. 6 is an exploded view of a lower handle assembly of the steam mop shown in FIG. 5.
Figure 7:
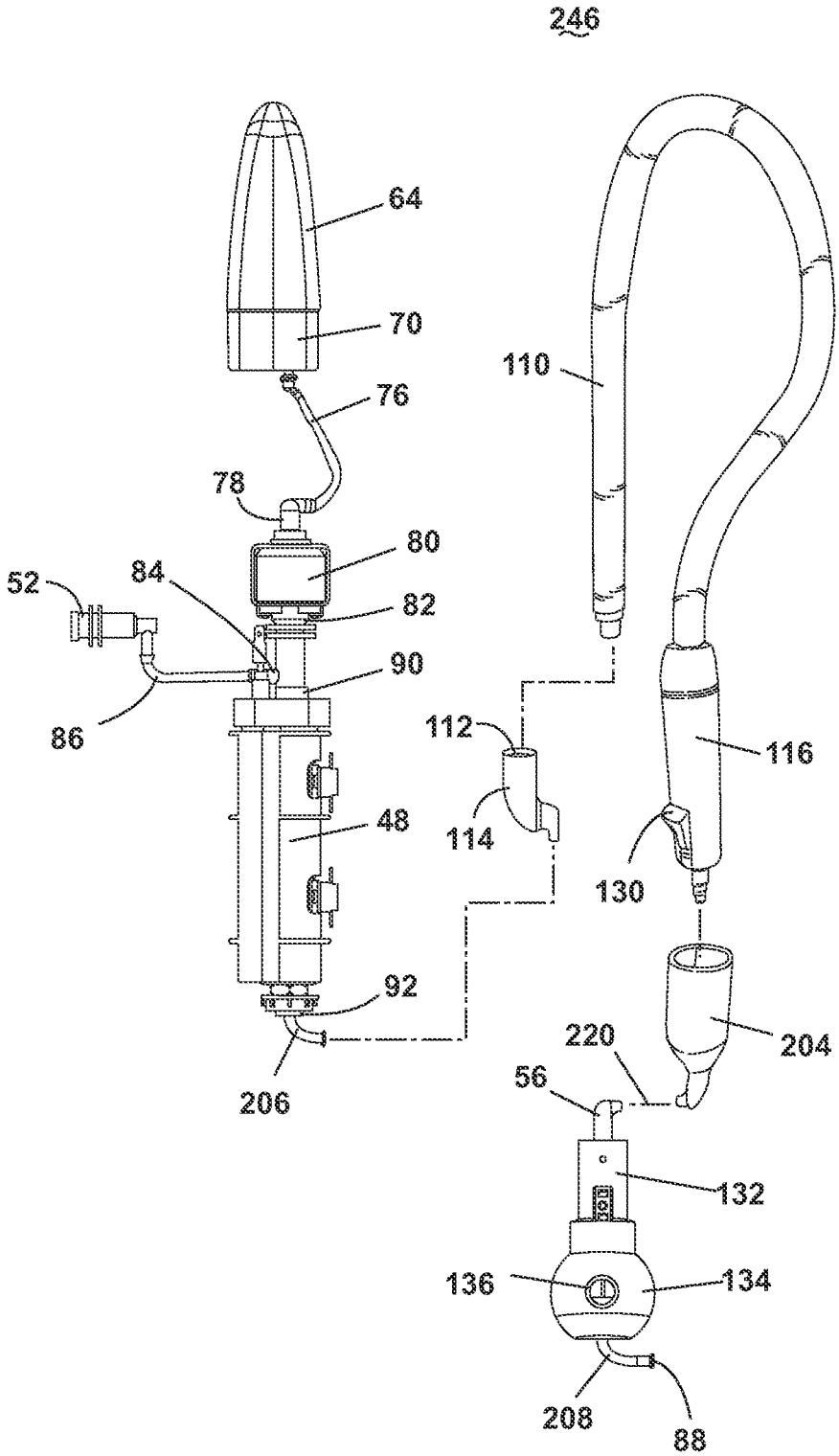
FIG. 7 is a diagram of a fluid distribution system of the steam mop shown in FIG. 5.

Referring to FIGS. 5-7, in a second embodiment of the invention where similar elements from the first embodiment are labeled with the same reference numerals, the steam mop 200 comprises a "live hose" fluid distribution system 246. In this embodiment, the lower handle assembly 218 includes a receiver 204 mounted thereto. The fluid distribution system 246 comprises the water tank assembly 64, filter assembly 70, first water tube 76, pump 80, T-connector 84, second water tube 86, pressure relief valve 52, steam generator 48, and a first steam tube 206. The first steam tube 206 is fluidly connected to the steam conduit 114, to which the steam hose 110 is fluidly connected by the hose fitting 112. At the distal end, the steam hose 110 is fluidly connected to the handheld nozzle 116, which is selectively received in the receiver 204.

The lower end of the receiver 204 is fluidly connected to a second steam tube 208 and spray nozzle 88, located in the foot 14 through conduit 220, conduit 56, connector 132 and swivel ball joint 134. For floor steam cleaning, the handheld nozzle 116 is received in the receiver 204 and trigger 130 is compressed, opening the valve (not shown) and passing steam therethrough. Thus, for the floor cleaning mode, steam is directed from the water tank assembly 64, through the steam hose 110, and to the spray nozzle 88, thereby forming the "live hose" fluid distribution system 246. Thus, in this embodiment, the receiver 204 and the trigger 130 form a fluid control system for the fluid distribution system 246 for selectively distributing steam onto the surface to be cleaned when the handheld nozzle 116 is received in the receiver 204 and the auxiliary hose 110 selectively distributes steam from the fluid distribution system 246 onto the surface to be cleaned when the handheld nozzle 116 is removed from the receiver 204.

For above-floor steam cleaning, the handheld nozzle 116 is removed from the receiver 204, releasing the trigger 130 and closing the valve (not shown). As described above, the user can selectively squeeze the trigger 130, opening the valve and passing steam from the fluid distribution system 246 through the steam hose 110 and out the handheld nozzle 116.

Figure 8:
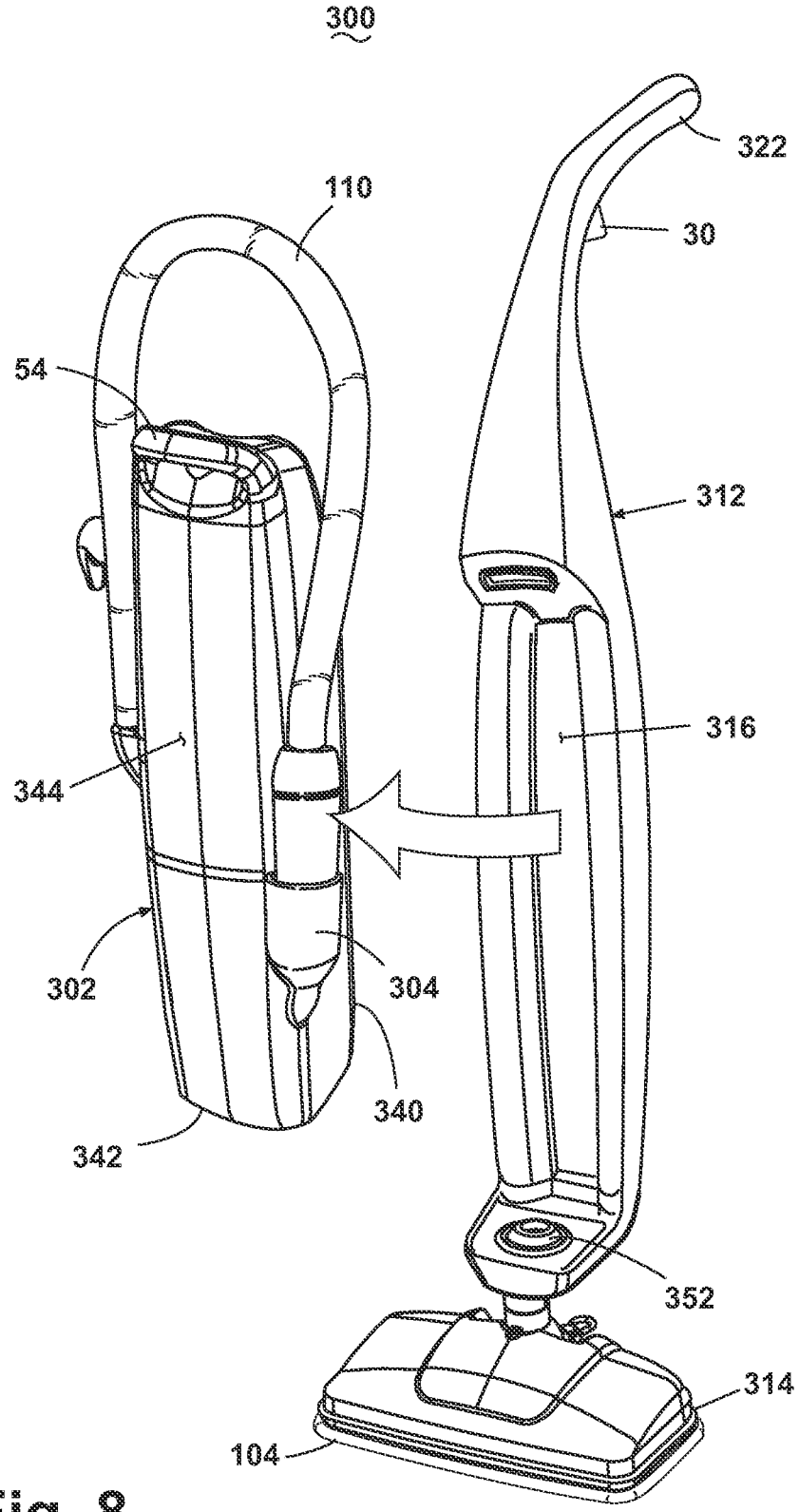
FIG. 8 shows a steam mop having a steam module according to a third embodiment of the invention.
Figure 9:
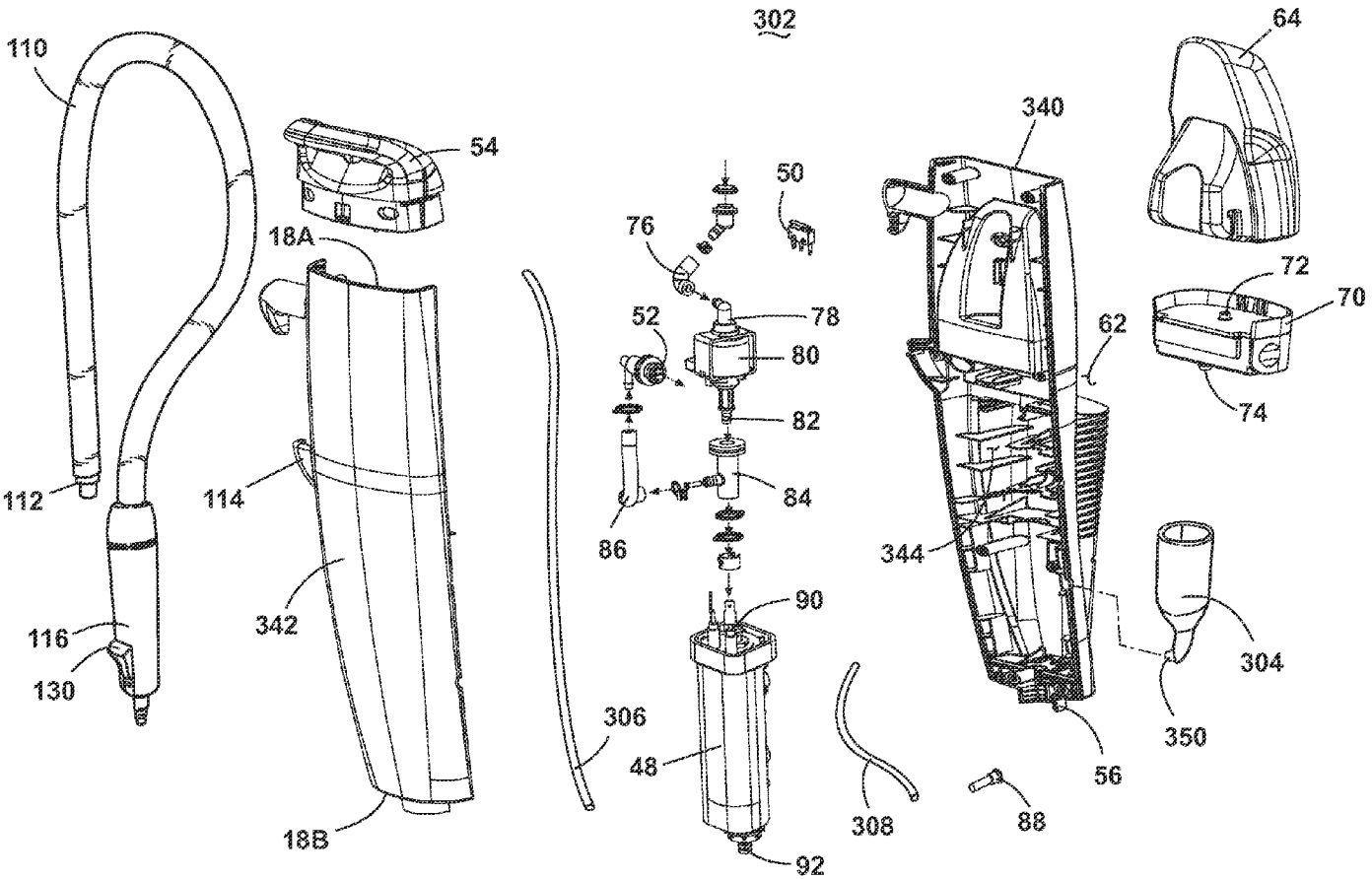
FIG. 9 is an exploded view of the steam module shown in FIG. 8.
Figure 10:
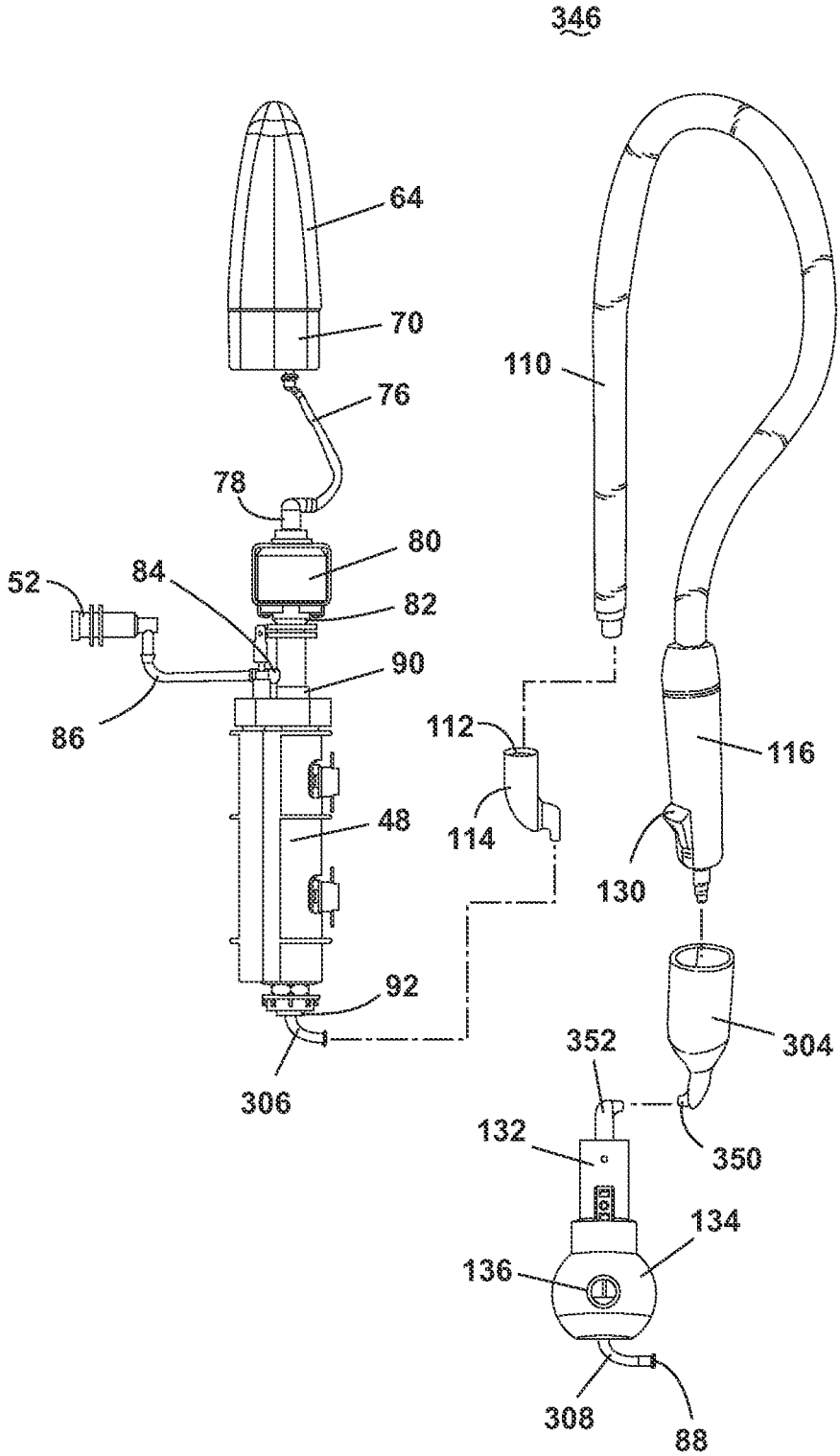
FIG. 10 is a diagram of a fluid distribution system of the steam mop shown in FIG. 8.

Referring to FIGS. 8-10, in a third embodiment of the invention where similar elements from the first embodiment are labeled with the same reference numerals, the steam mop 300 generally comprises a housing that includes a selectively removable steam module 302, a handle assembly 312, and a foot 314. The handle assembly 312 is pivotally mounted to the foot 314 and can pivot from an upright position to a lowered, in-use position. The steam module 302 is removable to provide the user an even greater degree of portability and flexibility for sanitizing above-floor surfaces.

The handle assembly 312 comprises a commonly known grip assembly 322 having a trigger 30 mounted thereto, and a recess 316 in which the steam module 302 is mounted.

The steam module 302 is removably mounted to the handle assembly 312 and is comprised of a rear enclosure 340 and a front enclosure 342, which mate together to form a central cavity 344 therebetween to house a fluid distribution system 346. Additionally, the steam module 302 includes a receiver 304. The steam module 302 further comprises a carry handle 54 to facilitate removing the steam module 302 from the steam mop 300. The steam module 302 can optionally comprise a latch assembly (not shown) mounted thereto for selectively interlocking the steam module 302 to the handle assembly 312. One suitable latch assembly is disclosed in U.S. Pat. No. 5,524,321, which is incorporated herein by reference. The water tank assembly 64 is also removably mounted to the steam module 302.

Referring to FIG. 10, the fluid distribution system 346 comprises the water tank assembly 64, filter assembly 70, first water tube 76, pump 80, T-connector 84, second water tube 86, pressure relief valve 52, steam generator 48, and a first steam tube 306. The first steam tube 306 is fluidly connected to the steam conduit 114 and steam hose 110, as described above. At the distal end, the steam hose 110 is fluidly connected to the handheld nozzle 116, which is selectively received in the receiver 304.

The lower end of the receiver 304 is fluidly connected to a second steam tube 308 and spray nozzle 88, located in the foot 314, through receptacle port 352, connector 132 and swivel ball joint 134. For floor steam cleaning, the handheld nozzle 116 is received in the receiver 304 and the trigger 130 is compressed, opening the valve (not shown) and passing steam therethrough. Thus, for the floor cleaning mode, steam is directed from the water tank assembly 64, through the steam hose 110, and to the spray nozzle 88 for distribution to the cleaning cloth 104.

The fluid distribution system 346 further comprises an outlet port 350 and a receptacle port 352. The outlet port 350 is located in the lower, closed-end of the receiver 304 and the receptacle port 352 is located in the handle assembly 312 at the bottom of the recess 316. The outlet port 350 has an outlet valve (not shown) that is closed when the outlet port is separated from the receptacle port 352 and opens when the outlet port 350 is connected to the receptacle port 352 to selectively enable and prevent fluid communication between the steam module 302 and the foot 314. With the steam module 302 installed, the outlet port 350 is adapted to open in fluid communication with the receptacle port 352, thus fluidly connecting the water tank assembly 64 with the foot 314 nozzle 88. When the steam module 302 is removed from the handle assembly 312, the outlet port 350 is closed, thereby preventing steam from passing through the receiver 304. With the steam module 302 removed, steam generated by the enclosed fluid distribution system 346 can be selectively applied to the surface to be cleaned by the handheld nozzle 116. The described outlet and receptacle port 350, 352 can comprise any type of suitable valves that are commonly known in the art. A suitable outlet valve is disclosed in U.S. Pat. No. 6,167,586, which is incorporated herein by reference.

Figure 11:
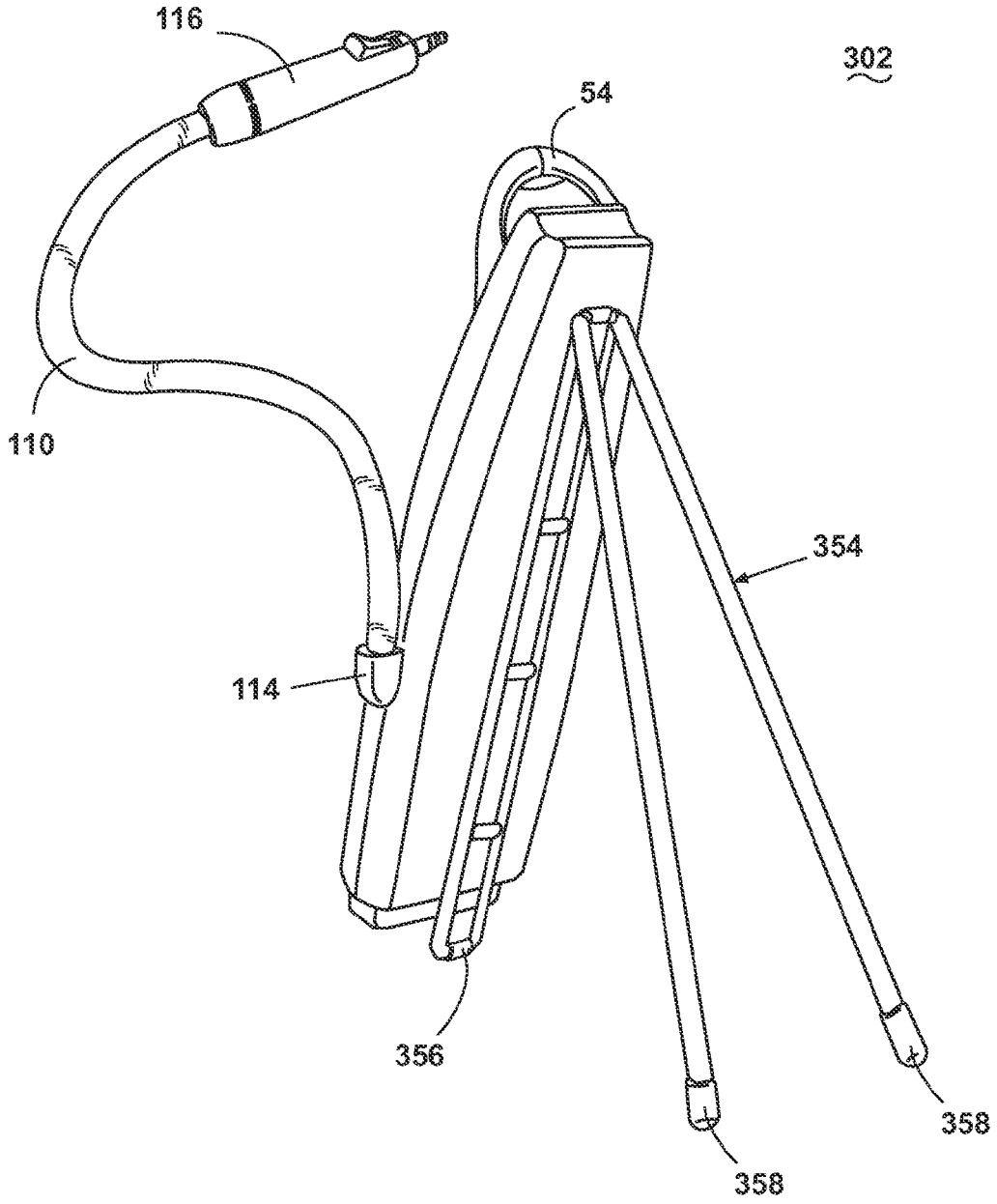
FIG. 11 shows a stand for the steam module shown in FIG. 8.

Now referring to FIG. 11, the steam module 302 further includes a support stand 354 for supporting the steam module 302 when removed from the steam mop 300. The stand 354 comprises an actuator 356 and two legs 358. Similar to that of the commonly known golf bag stand, when the steam module 302 is placed on the ground, the actuator 356 automatically deploys the legs 358 to their supporting position. When the steam module 302 is lifted off the ground, the legs 358 automatically move back to their retracted position.

The steam mop 10, 200, 300 can be operated as a bare floor cleaner that utilizes a disposable or re-usable, washable cleaning cloth 104 and steam for improved cleaning. When the steam mop fluid distribution system 46, 246, 346 is activated by depressing the trigger 30, steam is distributed onto cleaning cloth 104 and transferred to the surface to be cleaned. When used for above-floor cleaning, the steam mop fluid distribution system 46, 246, 346 is activated by depressing the trigger 130 and steam is released through the auxiliary handheld nozzle 116.

A fourth embodiment of the invention shown in FIGS. 12-16 comprises a steam mop 400 with a selectively removable steam module 402 mounted to an upright handle assembly 312 that is swivelably connected to a foot 14. The handle assembly 312 comprises a modular support frame 318 that forms a cavity 320 to receive and support the steam module 402 when it is mounted to the handle assembly 312. In addition, a fitting 472 projects upwardly from the bottom of the cavity 320. The removable steam module 402 further comprises a pivoting steam hose conduit 403 that is connected at one end to one end of the hose 110 and a variable steam moisture controller 404. Features that are similar to those of previous embodiments are identified with the same reference numerals.

Figure 12:
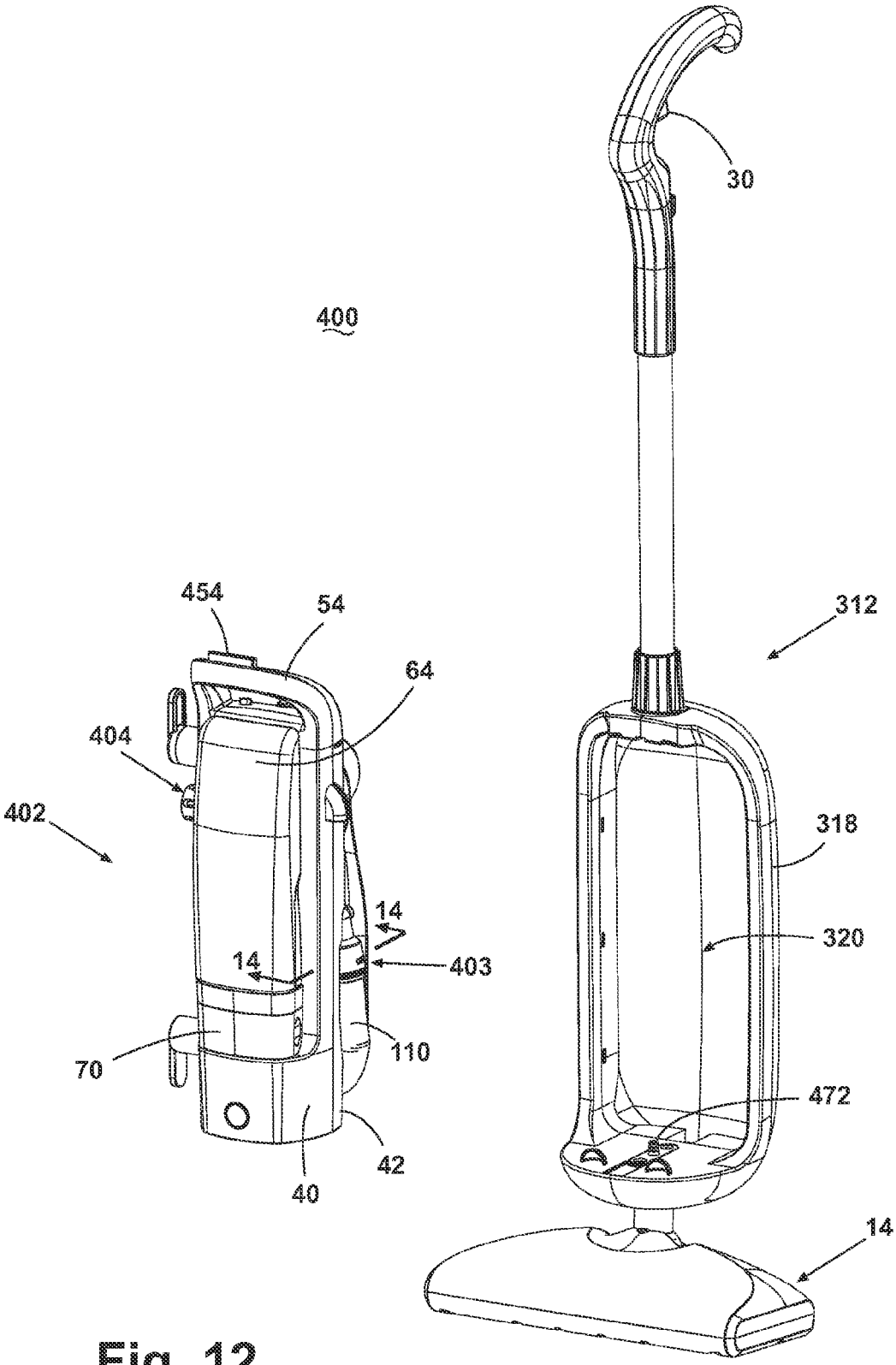
FIG. 12 shows a steam mop with a detachable steam module according to a fourth embodiment of the invention.
Figure 13:
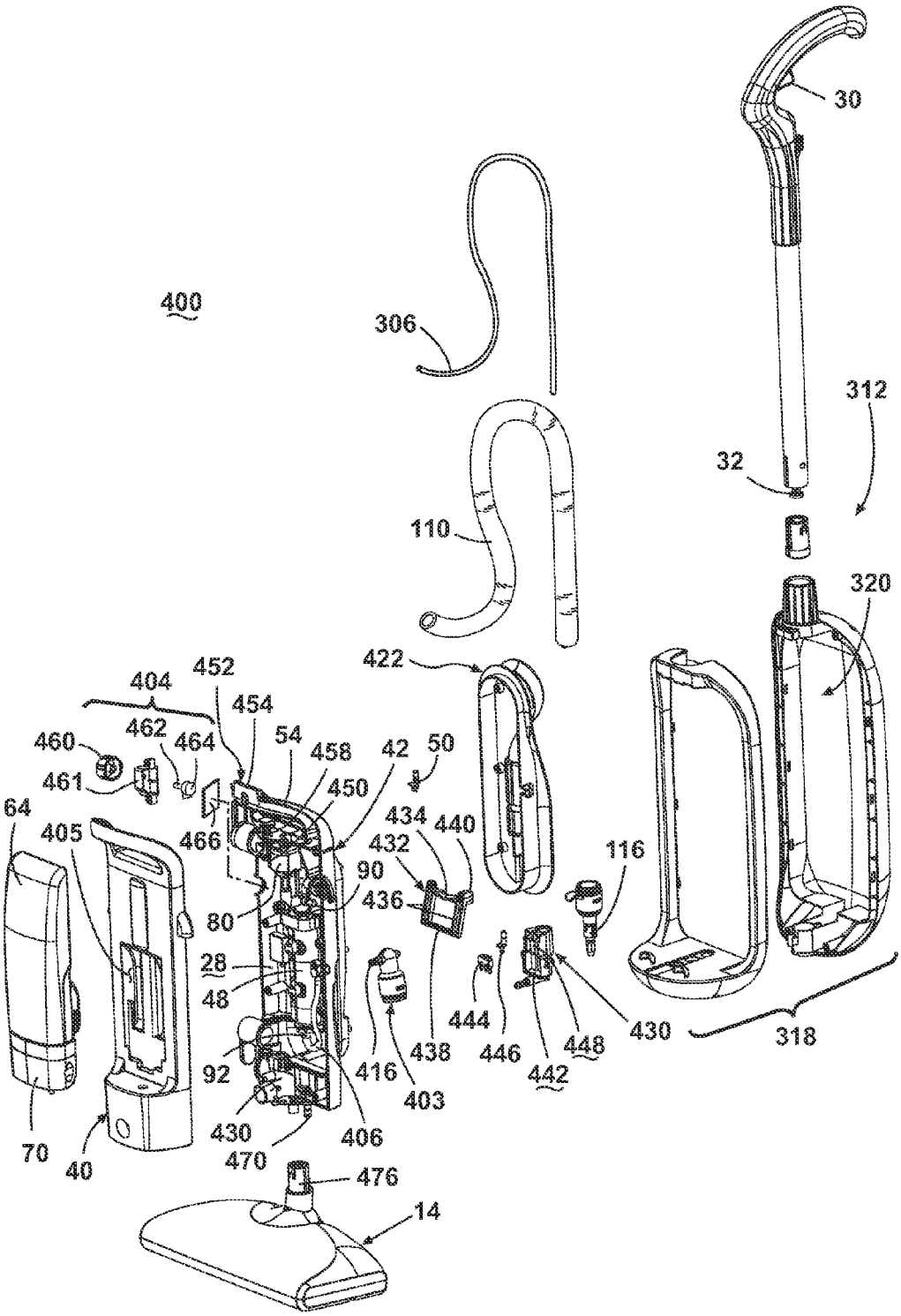
FIG. 13 is a partial exploded view of the steam mop of FIG. 12.
Figure 14:
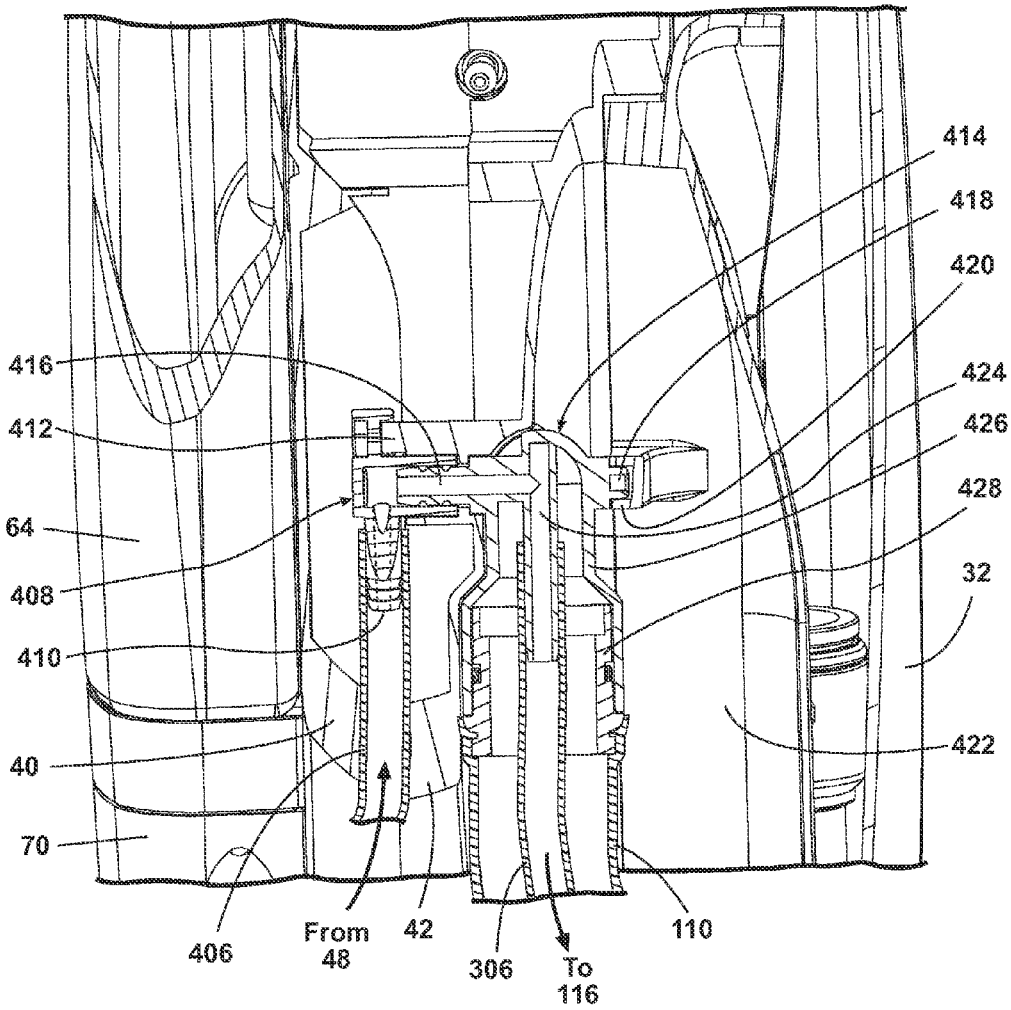
FIG. 14 is a section view along line 14-14 of FIG. 12.

Referring to FIGS. 12-16, the selectively removable steam module 402 comprises the front enclosure 40 secured to the rear enclosure 42 forming the cavity 28 therein for mounting several components of the fluid delivery system previously described. The water tank 64 and corresponding filter assembly 70 are slidably mounted to a recess 405 on the front surface of the front enclosure 40 and fluidly connected to the solenoid pump 80 mounted within the cavity 28. The pump 80 is fluidly connected to the boiler inlet 90 of the steam generator 48, which is connected to downstream steam tubing via the boiler outlet 92. A jumper tube 406 connects the boiler outlet 92 to a coupling inlet fitting 408 (FIG. 14). The coupling inlet fitting 408 comprises an inlet barb 410 adapted to receive the jumper tube 406. The inlet fitting 408 is fluidly connected to the proximal side of a hollow boss 412 that extends through the rear wall of the rear enclosure 42, thus forming a steam flow path therethrough. The inlet fitting 408 can be attached to the boss 412 via a mechanical fastener, adhesive, ultrasonic welding, or the like. Alternatively, the inlet fitting 408 can be formed integrally to the rear enclosure 42.

The pivoting steam hose conduit 403 comprises a pivoting tube coupling 414 that is adapted to rotate about a male inlet barb 416 and a coaxial opposed pin 418. The male inlet barb 416 rotates within the distal end of the boss 412 in the rear enclosure 42 and the opposed pin 418 is rotatably received within a corresponding socket 420 formed within the inner surface of a steam hose rack 422. The circumference of the male inlet barb 416 includes a circular groove adapted to receive an O-ring (not shown) that is sized to rotatably seal the male inlet barb 416 within the boss 412. The horizontally oriented male inlet barb 416 is fluidly connected to an orthogonally oriented outlet barb 424 that protrudes outwardly from a cylindrical collar 426 of the pivoting tube coupling 414. The cylindrical collar 426 is adapted to receive a hose collar 428 that is fixed to the proximate end of the steam hose 110. The steam hose 110 surrounds and insulates the internal first steam tube 306 that fluidly connects the outlet barb 424 to the handheld nozzle 116. The pivoting tube coupling 414 is adapted to rotate freely with respect to the rear enclosure 42 and hose rack 422 through an angular range of approximately 180 degrees to permit facile manipulation of the steam hose 110 and handheld nozzle 116. The rotating seal formed between the rear enclosure 42 and the pivoting conduit 403 prevents undesirable kinking of the steam tubing 306 and the steam hose 110.

The handheld nozzle 116 is selectively and slidingly retained within a receiver 430 that is mounted to the rear enclosure 42 and protrudes through an opening in the hose rack 422. A locking collar 432 is configured to selectively retain the handheld nozzle 116 within the receiver 430 and comprises an arcuate partial flange 434 connected to a frame 436 that rotates about a pivot bar 438 spanning the bottom of the frame. A release button 440 protrudes from an upper portion of the frame and is exposed through an access hole in the hose rack 422. The locking collar 432 is pivotally retained between the rear enclosure 42 and the hose rack 422 and is normally biased outwardly by a coil spring (not shown) mounted between the locking collar 432 and the rear enclosure 42. The arcuate partial flange 434 of the locking collar 432 is adapted to retain the handheld nozzle 116 when the handheld nozzle is seated within the receiver 430. To release the handheld nozzle 116, a user depresses the release button 440, which rotates the locking collar 432 rearwardly about the pivot bar 438, thus disengaging the arcuate partial flange 434 from the handheld nozzle 116 and permitting removal from the receiver 430.

The receiver 430 comprises a pocket 442 formed in the back side adapted to house a second microswitch 444 therein. The second microswitch 444 is operably connected to a spring biased plunger 446 that is configured to slide vertically within a channel 448 formed within the receiver 430. The upper portion of the plunger 446 is exposed within the receiver 430 and is adapted to selectively engage the handheld nozzle 116. The lower portion of the plunger 446 is adapted to selectively engage the second microswitch 444. The handheld nozzle 116 engages the upper portion of the plunger 446 when the nozzle 116 is seated within the receiver 430, which forces the lower portion of the plunger to engage the second microswitch 444.

The second microswitch 444 is electrically connected to a third microswitch 450 that is mounted within an upper portion of the rear enclosure 42. The third microswitch 450 is positioned for selective actuation by a release latch 452. The release latch 452 is slidingly mounted within the carry handle 54 of the steam module 402. A release button/actuator 454 integral to the release latch 452 protrudes through an opening at the top of the carry handle 54 for convenient user access. Two catches (not shown), which are also formed integrally with the release latch 452, protrude through openings at the lower portion of the carry handle 54 and are configured to selectively mate with corresponding recesses (not shown) formed in the upright handle assembly 312 to selectively retain the steam module 402 to the handle assembly 312 as previously described. A spring biased upper plunger 458 is slidably mounted to a bracket (not shown) in the carry handle 54 and is in register with the release latch 452 and the third microswitch 450. When the release button/actuator 454 is depressed, the release latch 452 slides downwardly and engages the upper plunger 458, which, in turn, actuates the third microswitch 450. Additionally, downward movement of the release latch 452 simultaneously disengages the catches from the recesses in the upright handle assembly 312 when the steam module 402 is mounted to the upright handle 312.

Referring to FIGS. 12-13, the variable steam moisture controller 404 is mounted within an upper portion of the rear enclosure 42 and comprises an exposed rotating actuator knob 460 that is accessible at the side of the steam module 402. A rotating shaft 462 is secured to the knob 460 and operably connected to a variable resistor 464, which is electrically connected to a conventional printed circuit board assembly (PCBA) 466. Excluding the actuator knob 460, the aforementioned components are mounted within a controller housing 461 that is attached to the rear enclosure 42. The PCBA 466 is electrically connected to the solenoid pump 80 and is configured to vary the frequency of the pump 80 based on input from the variable resistor 464, which varies as the knob 460 is adjusted between high and low position limits corresponding to wet steam and dry steam settings. The pump 80 flow rate can be adjusted within a typical range of 25-50 ml/min. Varying the pump 80 flow rate controls the amount of moisture in the steam. Wet steam generally contains a combination of saturated steam and condensed hot-water droplets in suspension, whereas dry steam comprises saturated steam without suspended water droplets. Accordingly, steam wetness can be adjusted by rotating the actuator knob 460. When the actuator knob 460 is rotated to the dry steam setting corresponding to the lowest pump flow rate setting, a dryer steam is distributed to the cleaning surface. Conversely, rotating the actuator knob 460 to the wet steam setting, which corresponds to the highest pump flow rate setting, produces a wetter steam containing both hot water droplets and steam, which is suitable for cleaning heavily soiled areas. Although the variable steam moisture controller 404 is attached to the upper portion of the rear enclosure 42, alternate positions are contemplated.

Figure 15:
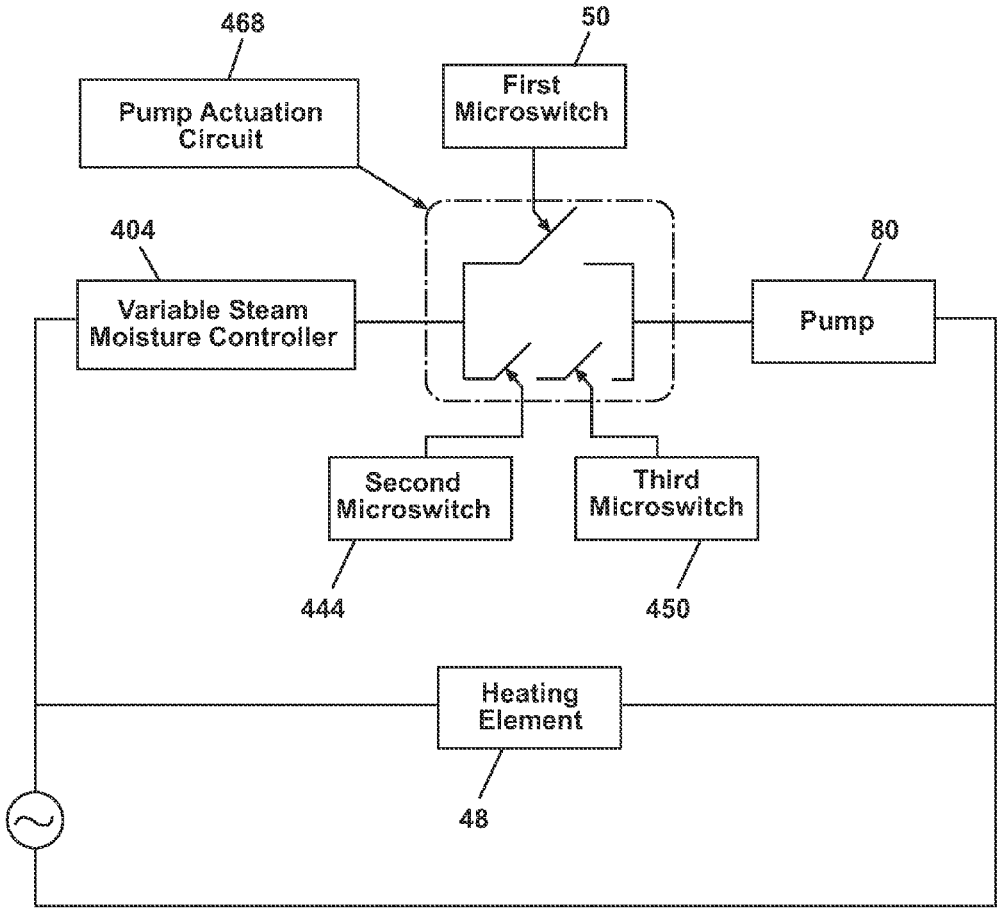
FIG. 15 is an electrical schematic of the steam mop shown in FIG. 12.

FIG. 15 shows an electrical schematic of the steam module 402 of the fourth embodiment of the invention. The electrical circuit comprises the steam generator 48 connected in parallel with the variable steam moisture controller 404 and solenoid pump 80. A pump actuation circuit 468 is connected in series with the pump 80 and variable steam moisture controller 404. The pump actuation circuit 468 comprises a parallel circuit with a first branch comprising the first microswitch 50 that is selectively connected to the pump 80 when the steam module 402 is secured to the handle assembly 312 and is operably connected to the trigger 30 and push rod 32 in the upper handle assembly 16 as previously described.

The second branch of the pump actuation circuit comprises the second and third microswitches 444, 450. When the steam module 402 is detached from the handle assembly 312, the first microswitch 50 is open and the pump 80 can be energized only when the second and third microswitches 444, 450 are closed. The second microswitch 444 mounted within the receiver 430 and is normally closed. Accordingly, when the handheld nozzle 116 is seated within the receiver, the plunger 446 engages the second microswitch 444 and opens the switch and circuit. Thus, the pump 80 cannot be energized when the steam module 402 is detached from the handle assembly 12 and the handheld nozzle 116 is seated within the receiver. However; when the handheld nozzle 116 is removed from the receiver 430, the spring biased plunger 446 moves upwardly and disengages the switch 444, which closes the switch 444 and partially closes the second branch of the pump actuation circuit 468. The third microswitch 450 is connected in series with the second microswitch 444 and is selectively engageable by the slidably mounted release latch 452. Accordingly, the pump 80 can be selectively energized by removing the handheld nozzle 116 from the receiver, which closes the second microswitch 444, and then selectively depressing the release button/actuator 454 on the release latch 452, which engages and closes the third microswitch 450.

Figure 16:
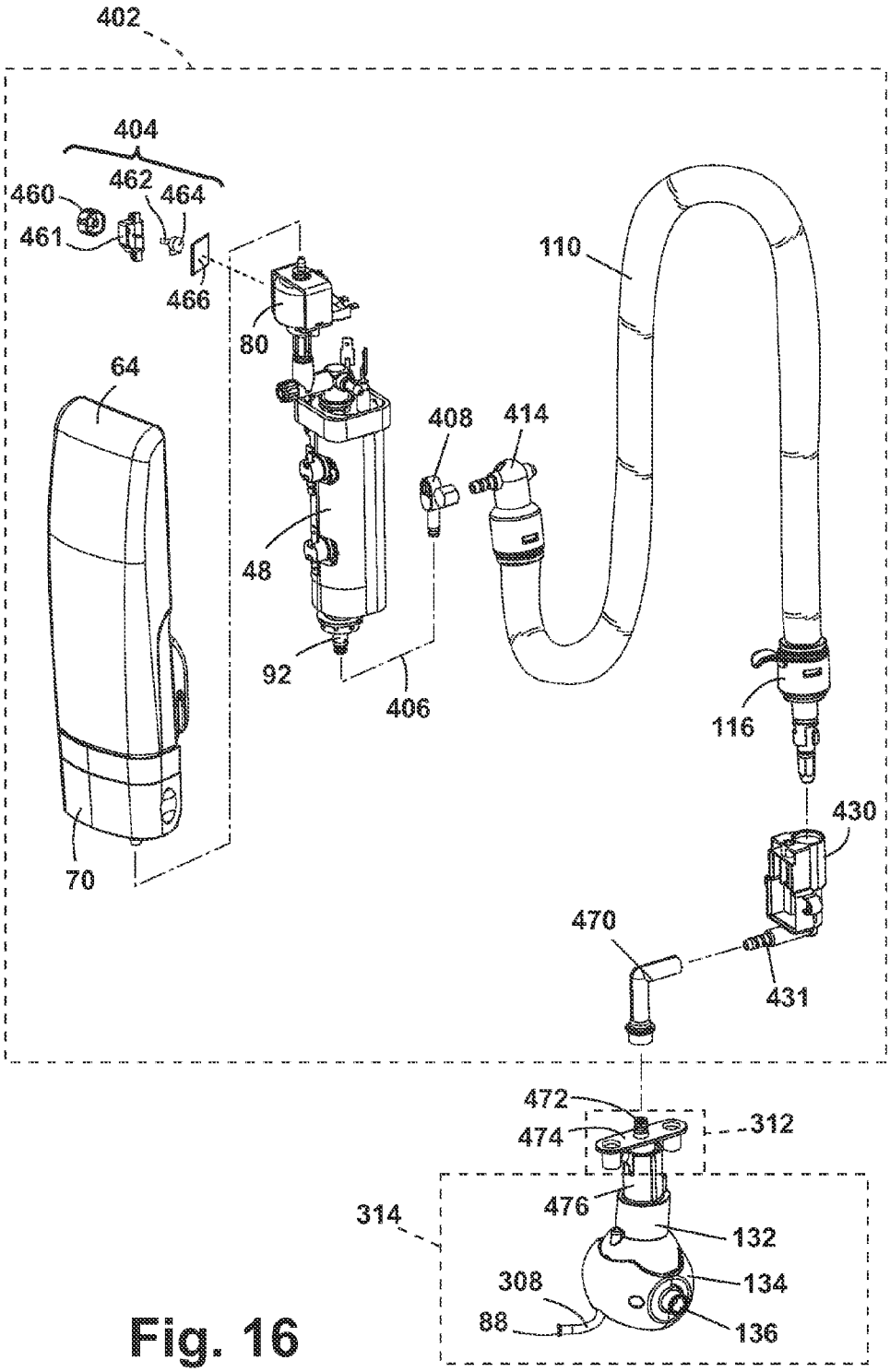
FIG. 16 is a diagram of a fluid distribution system of the steam mop shown in FIGS. 12-14.

Referring to FIG. 16, the fluid distribution system is illustrated. In particular, the receiver 430 has an outlet barb 431 that is connected to a conduit 470, the fitting 472, which is supported by bracket 474 in the handle assembly 312, and to the second steam tube 308 through a connector tube 476, connector 132 and swivel ball joint 134.

In operation, the steam mop 400 can be operated either with the steam module 402 secured to the upright handle assembly 312 for floor cleaning mode or detached from the upright handle 312 for above-floor steam cleaning. A user detaches the steam module 402 from the upright handle assembly 312 by depressing the release button/actuator 454 on the release latch 452, which disengages the catches 456 from the corresponding recesses in the upright handle assembly 312.

A user can rotate the steam moisture control knob 460 to the desired "wet", "dry", or intermediate steam wetness setting, thereby changing the variable resistor 464 input to the PCBA 466, which, in turn, adjusts the frequency of the solenoid pump 80, thus increasing or decreasing the pump 80 flowrate. Next, a user depresses the release button 440 on the locking collar 432 to disengage the arcuate partial flange 434 from the handheld nozzle 116. As the user removes the handheld nozzle 116 from the receiver 430, the spring biased plunger 446 moves upwardly and disengages the second microswitch 444, thus closing the switch and partially closing the second branch of the pump actuation circuit 468. Next, the user selectively energizes the solenoid pump 80 by depressing the release button/actuator 454 on the release latch 452, which engages and closes the third microswitch 450, thus energizing the solenoid pump 80. When energized, the pump 80 draws water from the tank 64, and pumps it through the steam generator 48, which flash heats the water to generate steam or a mixture of steam and suspended water droplets, depending on the steam moisture controller 404 setting. The steam is pushed out of the boiler outlet 92 through the jumper tube 406, inlet fitting 408, into the male inlet barb 416 of the pivoting conduit 403, through the outlet barb 424, into the steam tube 306, whereupon it is distributed onto the cleaning surface through the handheld nozzle 116. Commonly known accessory tools can be attached to the handheld nozzle to accomplish various steam cleaning functions.

Alternatively, when the steam module 402 is secured to the upright handle and the handheld nozzle 116 is seated within the receiver 430, the pump 80 can be energized, by depressing the trigger 30, which engages the first microswitch 50 via the push rod 32 and distributes steam through the foot 14 as previously described herein.

The steam mop of the described invention offers a high degree of flexibility because it can be used in multiple configurations for steam cleaning in the home. Because the steam mop uses water and not chemicals, it is environmentally friendly and has the advantage of creating a temperature which effectively kills a wide range of microbes, bacteria, microorganisms, and mites. The steam mop can be used for steam mopping the floor as well as above-floor surfaces through the use of the auxiliary hose. Further, the steam mop has a removable, portable steam module for even greater usage flexibility.

While the invention has been described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A bare floor cleaner comprising:

a housing having a foot and an upright handle assembly pivotally mounted to the foot; and a fluid distribution system comprising:

a steam module removably mounted to the upright handle assembly, and comprising a steam generator having an inlet and an outlet;

a fluid distributor in the foot for distributing steam to a floor surface;

an auxiliary hose coupled to the steam module such that the auxiliary hose is removable with the steam module from the upright handle assembly; and a fluid control system associated with the fluid distribution system for selectively distributing steam to the fluid distributor;

wherein the auxiliary hose is coupled to the exterior of the steam module such that a first end of the auxiliary hose is removable from the steam module for distributing steam to an above-the-floor surface.

2. The bare floor cleaner according to claim 1 wherein the fluid control system includes a diverter valve and a selector for selectively controlling the diverter valve for distributing steam either to the foot or the auxiliary hose.

3. The bare floor cleaner according to claim 1 wherein the auxiliary hose has a handheld nozzle and a fluid control valve, and the fluid control system comprises a receiver mounted on the housing for selectively receiving the handheld nozzle and to open the fluid control valve when the handheld nozzle is positioned in the receiver;

wherein steam is distributed to the floor via the fluid distributor when the handheld nozzle is received in the receiver and steam is distributed through the auxiliary hose when the handheld nozzle is removed from the receiver.

4. The bare floor cleaner according to claim 3 wherein the fluid control system comprises an electrical system for controlling the output of steam from the steam generator when the steam module is mounted to the upright handle and for controlling the delivery of steam from the steam generator to the auxiliary hose when the steam module is removed from the upright handle.

5. The bare floor cleaner according to claim 4 wherein the fluid distribution system comprises a water tank and a pump connected to the water tank and to the steam generator inlet for supplying water to the steam generator, and wherein the fluid control system comprises an electrical circuit for controlling power to the pump.

6. The bare floor cleaner according to claim 1 wherein the steam module includes a water tank adapted to hold a quantity of water that is fluidly connected to the steam generator inlet.

7. The bare floor cleaner according to claim 1 and further comprising a cleaning cloth which covers at least a portion of an under surface of the foot and is positioned for contacting the surface to be cleaned.

8. The bare floor cleaner according to claim 7 wherein the fluid distributor is positioned above the cleaning cloth for distributing steam to the cleaning cloth.

9. The bare floor cleaner according to claim 1 wherein the fluid control system further comprises a trigger on the handle operably connected to the fluid distribution system for selectively distributing steam onto the surface to be cleaned.

10. The bare floor cleaner according to claim 1 wherein the upright handle is pivotally mounted to the foot through a universal joint.

11. The bare floor cleaner according to claim 1 wherein the auxiliary hose comprises a flexible conduit, a handheld nozzle, and a manually operable fluid control valve.

12. The bare floor cleaner according to claim 1 wherein the steam module further comprises a support stand having support legs that can be deployed or retracted.

13. The bare floor cleaner according to claim 1 wherein the auxiliary hose is connected to the exterior of the steam module by an articulating joint.

14. The bare floor cleaner according to claim 13 wherein the auxiliary hose is mounted to the articulating joint for rotation about an axis.

15. The bare floor cleaner according to claim 1 wherein the fluid distribution system further comprises a moisture controller for selectively controlling the amount of moisture in the steam delivered to the fluid distributor and to the auxiliary hose.

16. The bare floor cleaner according to claim 1 wherein the auxiliary hose comprises a live hose with a second end in fluid communication with the outlet of the steam generator, and wherein the live hose is configured to be fluidly coupled to the fluid distributor in the foot via the first end when the steam module is mounted to the upright handle.

* * * * *